United States Patent [19]

Brandenburger

[11] Patent Number: 4,477,014

[45] Date of Patent: Oct. 16, 1984

[54] TRIANGULAR CARTON AND OPENING MEANS THEREFOR

[75] Inventor: Allen M. Brandenburger, Clarkston, Ga.

[73] Assignee: Container Corporation of America, Chicago, Ill.

[21] Appl. No.: 491,583

[22] Filed: May 4, 1983

[51] Int. Cl.[3] ..... B65D 5/54

[52] U.S. Cl. ..... 229/22; 206/607; 206/624; 206/633; 206/634

[58] Field of Search ..... 229/22, 40; 206/611, 206/625, 628, 624, 607, 634, 633

[56] References Cited

U.S. PATENT DOCUMENTS

| | | | |
|---|---|---|---|
| 1,716,975 | 6/1929 | Phillips | 229/22 |
| 2,299,461 | 10/1942 | Chanon | 206/624 |
| 2,583,915 | 1/1952 | Whitley | 229/22 |
| 3,142,430 | 7/1964 | Meyers | 229/22 |
| 3,669,345 | 6/1972 | Cote | 206/607 |
| 4,313,542 | 2/1982 | Roberts | 229/22 |

FOREIGN PATENT DOCUMENTS

| | | | |
|---|---|---|---|
| 1444953 | 8/1976 | United Kingdom | 229/22 |

*Primary Examiner*—William Price
*Assistant Examiner*—Gary E. Elkins
*Attorney, Agent, or Firm*—Richard W. Carpenter

[57] ABSTRACT

A generally triangular carton having hinged body and cover member and including means for separating certain said members from each other to open the carton.

1 Claim, 4 Drawing Figures

TRIANGULAR CARTON AND OPENING MEANS THEREFOR

BACKGROUND OF THE INVENTION

1. Field of the Invention:

This invention relates to triangular paperboard cartons for holding wedge-shaped articles and more particularly to an improved opening means therefor.

2. Description of the Prior Art:

A prior art search in the United State Patent and Trademark Office directed to the subject matter of this application disclosed the following U.S. Pat. Nos. : 2,220,110; 2,298,146; 2,583,915; 2,584,379; 2,701,090; 3,142,430; 3,239,129; 4,313,542.

None of the prior art patents uncovered in the search discloses a carton having body and cover portions joined by transversely extending lines of weakness and providing means for grasping the cover portion to partially separate it from the body portion of the carton.

SUMMARY OF THE INVENTION

An object of the present invention is to provide a generally triangular paperboard carton having hingedly interconnected body and cover portions and including means for facilitating opening of the carton to afford access to the contents thereof.

A more specific object of the invention is the provision of a carton closure arrangement wherein the cover portion has at least one side wall panel secured to the body portion and including means for grasping and separating the cover portion from the body portion to open the carton.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
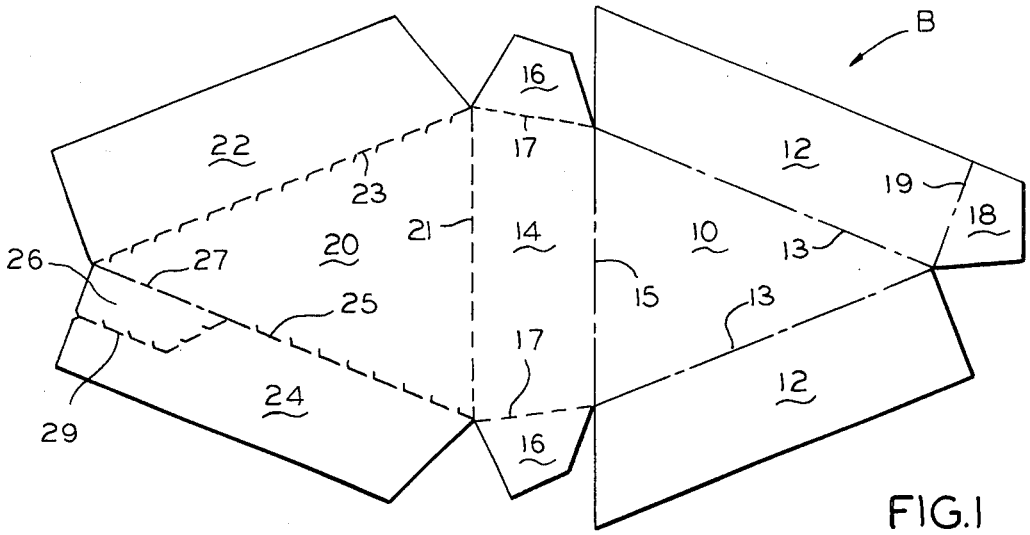
FIG. 1 is a plan view of a blank of foldable sheet material, such as paperboard, from which the carton illustrated in the other views may be formed.
Figure 2:
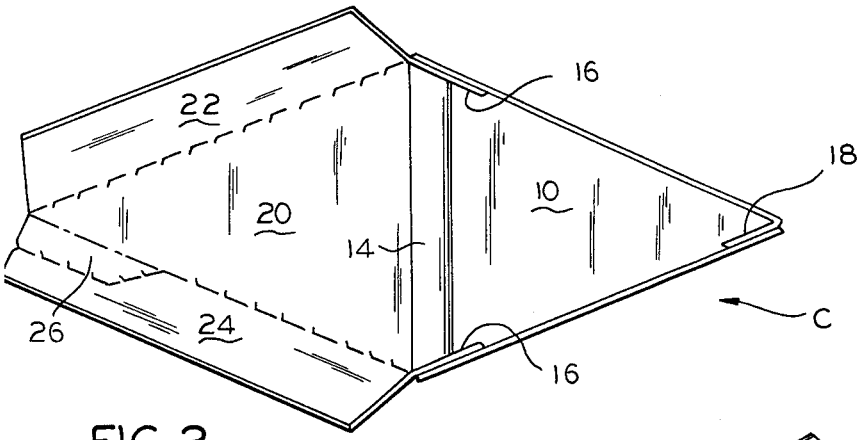
FIG. 2 is a plan view of the structure illustrated in FIG. 1, but illustrating one stage in the formation of the carton from the blank.
Figure 3:
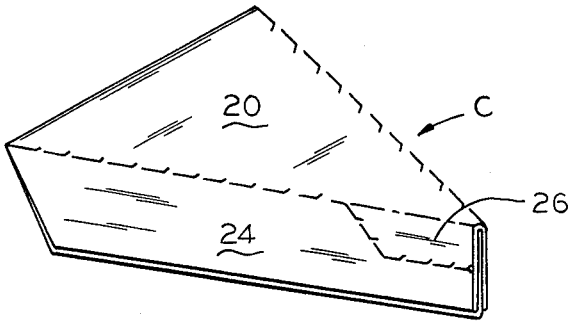
FIG. 3 is a perspective view of an assembled and closed carton.

Referring now to the drawings for a better understanding of the invention, and particularly FIGS. 1 and 3, it will be seen that the novel carton, indicated generally at C in FIG. 3, may be formed from the unitary blank B of foldable sheet material, such as paperboard, illustrated in FIG. 1.

The carton includes body and cover portions or members hingedly attached to each other. The body member includes a generally triangular-shaped bottom wall panel 10 having a pair of opposed side wall inner panels 12 and a rear wall panel 14 foldably joined to opposed side edges and a rear edge thereof, respectively, and upstanding therefrom.

The side wall inner panels 12 may be joined to each other by a front corner flap 18, which is foldably joined along a fold line 19 to a front edge of one side wall inner panel 12 and adhesively secured to the other panel 12. Panels 12 may also be secured to rear wall panel 14 by a pair of rear corner flaps 16, which are foldably joined along fold line 17 to opposite end edges of rear wall panel 14 and adhesively secured to side wall inner panels 12.

The cover member of the carton includes a generally triangular top wall panel 20 having a pair of side wall outer panels 22 and 24 which are foldably joined to opposed side edges thereof along converging fold lines 23 and 25 and which depend therefrom to overlie respective side wall inner panels 12.

Fold lines 23 and 25 are preferably defined by a series of cuts or perforations defining a weakened lines of tear which facilitate permit the separation of the cover portion from the body portion of the carton.

Line 25 does not extend the entire length of side wall outer panel 24 but only approximately three fourths of the length. For the remaining distance the top wall panel 20 and the side wall panel 24 are joined by a regular scored fold line 27 which is aligned with weakened line of tear 25.

An additional weakened line of tear 29 extends from the end of line 24 downwardly and then outwardly to the end of panel 24 to provide a tab 26, attached to top wall panel 20 on fold line 27, which facilitates opening of the carton.

Figure 4:
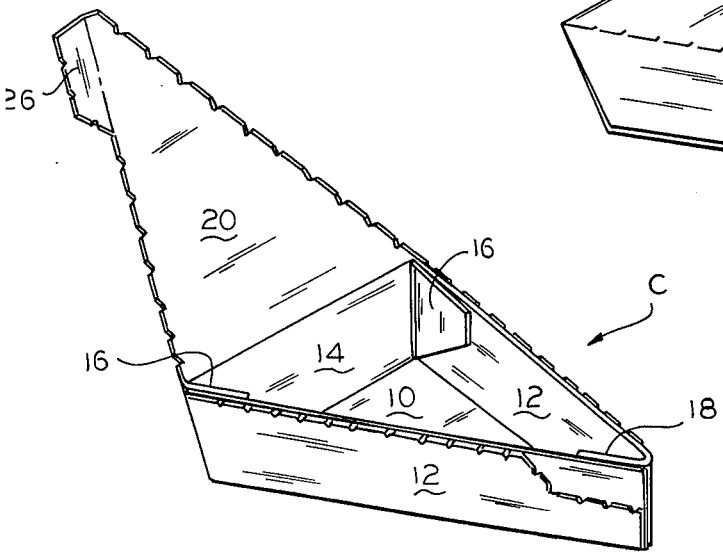
FIG. 4 is a view of the structure illustrated in FIG. 3, but with the cover portion shown separated from the body portion and in an open position.

In the formation of the carton C from the blank B, as best seen in FIG. 4, it will be understood that the cover member side wall outer panels 22 and 24 overlie and are adhesively secured to the outer surfaces of related body member side wall inner panels 12, with only the tab 26 of the outer panel 24 being free from attachment to its related inner panel.

Thus, when it is desired to open the carton the cover member may be grasped by inserting a finger or thumb behind tab 26 of the cover member side wall outer panel 24 and pulling upwardly to separate the cover portion of the carton from the body portion and thereby easily and quickly open the carton to afford access to the contents of the carton.

What is claimed is:

1. A generally triangular carton for holding a single wedge-shaped piece of pastry or the like, said carton being formed from a unitary blank of foldable sheet material, such as paperboard, and comprising:

(a) a body member including a generally triangular bottom wall panel having a rear wall panel and pair of opposed, converging side wall inner panels foldably joined to the rear and side edges thereof and to each other and extending upwardly from said bottom wall panel to form a tray-like structure;

(b) a cover member including:

(i) a generally triangular top wall panel foldably joined at its rear edge to an upper edge of said body member rear wall panel;

(ii) a pair of opposed, converging side wall outer panels foldably joined to side edges of said top wall panel and disposed to extend downwardly therefrom in overlying relation with respective body member side wall inner panels;

(c) each of said side wall outer panels including a single line of weakness separating said side wall panel from said top wall panel and located at the juncture of said outer panel and said top wall panel and extending generally transversely from the rear of said outer panel toward the front thereof;

(d) one of said outer panels including an upper pull tab portion joined to said top wall panel adjacent the front end thereof by a relatively short fold line and being joined to said one outer panel by a weakened line of tear extending downwardly from an upper edge thereof and outwardly to a free front edge thereof;

(e) said outer panel tab portion providing means to grasp said cover member and pull it upwardly in a single motion to separate it from said body member to open the carton and afford access to the contents thereof.

* * * * *